United States Patent [19]

Kanabara et al.

[11] Patent Number: 4,604,145

[45] Date of Patent: Aug. 5, 1986

[54] PROCESS FOR PRODUCTION OF STEEL BAR OR STEEL WIRE HAVING AN IMPROVED SPHEROIDAL STRUCTURE OF CEMENTITE

[75] Inventors: Susumu Kanabara; Kenji Aihara, both of Amagasaki, Japan

[73] Assignee: Sumitomo Metal Industries, Ltd., Osaka, Japan

[21] Appl. No.: 632,234

[22] Filed: Jul. 19, 1984

[30] Foreign Application Priority Data

Jan. 13, 1984 [JP] Japan ..... 59-4614
Jan. 13, 1984 [JP] Japan ..... 59-4615
Jan. 24, 1984 [JP] Japan ..... 59-9500

[51] Int. Cl.[4] ..... C21D 9/52
[52] U.S. Cl. ..... 148/12 B
[58] Field of Search ..... 148/12 B, 12.3, 12.4, 148/134, 142, 12 R

[56] References Cited

U.S. PATENT DOCUMENTS 3,926,687 12/1975 Gondo et al. ..... 148/12 B
4,016,009 4/1977 Economopolous et al. ..... 148/12 B
4,448,613 5/1984 Sherby et al. ..... 148/134

FOREIGN PATENT DOCUMENTS 56121 5/1978 Japan ..... 148/12 B
41322 3/1982 Japan ..... 148/12 R
98631 6/1982 Japan ..... 148/12 R
116727 7/1982 Japan ..... 148/12 B
3919 1/1983 Japan ..... 148/12 B
27926 2/1983 Japan ..... 148/12 B
58-235 4/1983 Japan ..... 148/12 B
107416 6/1983 Japan ..... 148/12 B
207325 12/1983 Japan ..... 148/12 B
850698 7/1981 U.S.S.R. ..... 148/12 R

*Primary Examiner*—Wayland Stallard
*Attorney, Agent, or Firm*—Burns, Doane, Swecker and Mathis

[57] ABSTRACT

Herein disclosed is a process for producing a steel bar or steel wire having an improved structure of spheroidal cementite. The process is characterized in that a finish rolling is conducted within a temperature range between $Ar_1$ and $Ar_3$ or Arcm with a reduction ratio of at least 20%.

The cooling rate of the steel before the finish rolling should be controlled in the following manner:

When the hardenability of the steel is not higher than that of 0.15% C plain carbon steel, it is preferable to cool the steel at a cooling rate higher than 250° C./sec.

When the hardenability of the steel is between those of 0.15% to 0.4% C plain carbon steel, it is preferable to cool the steel at a cooling rate higher than 10° C./sec.

When the hardenability of the steel is not lower than that of 0.4% C plain carbon steel, it is preferable to cool the steel at a cooling rate higher than 2° C./sec.

The annealing may be conducted on the same production line as the hot working of the steel for a shorter time duration by an isothermal treatment, slow cooling treatment or repeating treatment. The annealing may be conducted also by a usual annealing method.

7 Claims, 16 Drawing Figures

$a_1$ is the steel naturally cooled after the rollings No. 1 to 3.

$a_2$ is the steel naturally cooled after the rollings No. 1 to 6.

$a_3$ is the steel naturally cooled after the rollings No. 1 to 9.

$a_0$ is the steel naturally cooled after usual hot rolling.

PROCESS FOR PRODUCTION OF STEEL BAR OR STEEL WIRE HAVING AN IMPROVED SPHEROIDAL STRUCTURE OF CEMENTITE

FIELD OF THE INVENTION

The present invention relates to a process for production of steel bar or steel wire, and more particularly to a process for production of steel bar or steel wire having an improved spheroidal structure of cementite, in which the annealing treatment can be conducted on the same production line as the hot rolling.

PRIOR ART OF THE INVENTION

Among the steel materials, there are many kinds of steels which are employed as the spheroidizing-annealed condition. For example, the steels for cold forging are subjected to the spheroidizing treatment in order to increase the deformability and thus to reduce the resistance to mechanical working, and the bearing steels are subjected to the spheroidizing treatment in order to improve the resistance to abrasion, the cold workability and the cutting properties.

In the prior art, however, the steel bar or the coil of steel wire which were fabricated in the hot working line, were transferred to another line where the spheroidizing treatment was conducted in a heat treatment furnace. The spheroidizing annealing treatment of the prior art is classified into the following three kinds:

The first one is called the slow cooling method which comprises heating the steel to a temperature higher than $A_1$ and then slowly cooling the same;

the second one is called the isothermal method which comprises isothermally maintaining the steel at a temperature just below the $A_1$ point of the steel, the third one is called the repeating method which comprises repeating the steps of heating and cooling the steel around the $A_1$ point.

In these spheroidizing process, however, the time duration of the treatment is very long. For example, for the steels for cold forging such as SCr435, SCM435, etc. of the Japanese Industrial Standards (which will be hereinafter abbreviated as "JIS") and for the bearing steel such as SUJ2 of the JIS, the spheroidizing annealing treatment of 20 to 25 hours are necessary. In the case of the carbon steels for cold forging which can be relatively easily spheroidized, it necessitates a treatment of 15 to 20 hours.

For this drawback, the spheroidizing annealing treatment was not effectively related with a modern production line of the steel bar or steel wire, and therefore it has been conducted on a separate line. Further, the heat treatment of a long time invites problems of excessive consumption of energy and of the oxidation and decarbonization of the steel surface. Accordingly, an improvement and simplification of the spheroidizing annealing treatment has been desired for a long time and considered very useful.

As an improvement for shortening the time duration of the spheroidizing treatment, there has been proposed a pretreatment by cold working the steel to thereby introduce dislocations in the metallurgical structure of the steel by mechanically deforming the cementite. Such introduction of dislocations is effective for the dispersion of the residual cementite and the generation of nuclei of cementites in a dispersed form. Although this cold working is effective for shortening the time duration of the spheroidezing treatment, it adds a cold working step and thus does not effectively shorten the whole time duration of the process for fabrication of the steel bar or wire.

In this regard, there have been proposed in the Japanese patent Laid-open No. 27926/1983 and No. 13024/1984 process for conducting the spheroidizing treatement in the hot rolling line or in the secondary working step of the steel bar or wire.

In the process disclosed in the Japanese Laid-open No. 27926/1983, however, the temperature range in which the working should be conducted is defined in the terms of $Ae_3$ and $Ae_1$ which are the transformation temperatures in the equilibrium condition, while the process is not carried out in such condition. Thus, this process is difficult to conduct precisely in practice. Further, as explained in detail hereinafter, we found that the working temperature of this prior art is too high to effectively spheroidize the cementite.

In the process disclosed in the Japanese patent Laid-open No. 13024/1984, the working of the steel is conducted in the pearlite range, that is, below the $Ar_1$ point. Thus, the spheroidization of cementite is not attained uniformly and the resulting steel presents a high tensile strength due to the work hardening.

OBJECTS OF THE INVENTION

The present invention was developed based on the experiments on the thermo mechanical treatment for many years.

The main object of the invention is to provide a novel thermo mechanical process conducted in the hot working line or the secondary working line of the steel bar or the steel wire to obtain a steel product having an improved spheroidal structure of cementite.

That is, the object of the present invention is to provide a new process for production of steel bar or steel wire having an improved spheroidal structure of cementite.

The other object of the invention is to simplify the spheroidizing treatment to increase the efficiency of the production of steel bar or steel wire.

SUMMARY OF THE INVENTION

According to the present invention, there is provided a process for producing a steel bar or steel wire, which comprises:

heating a steel containing less than 2% of C at a temperature higher than the $Ac_1$ point of the steel;

rough working the heated steel;

finish working the rough-worked steel within a temperature range between $Ar_1$ and $Ar_3$ or Arcm with a reduction of at least 20%; and subjecting the finish-worked steel to an annealing treatment;

whereby providing a steel bar or steel wire having an improved spheroidal structure of cementite.

According to the present invention, the rough-rolled steel is cooled before the finish rolling. The cooling rate of this cooling should be chosen according to the hardenability of the steel in the following manner:

When the steel is a plain carbon steel containing not higher than 0.15% of C or a low alloy steel having a hardenability not higher than that of 0.15% C plain carbon steel, it is preferable to cool the rough-worked steel at a cooling rate higher than 250° C./sec. to a temperature between $Ar_1$ and $Ar_3$.

When the steel is a plain carbon steel containing 0.15 to 0.4% of C or a low alloy steel having a hardenability between those of 0.15% to 0.4% C plain carbon steel, it is preferable to cool the rough-worked steel at a cooling rate higher than 10° C./sec. to a temprature between $Ar_1$ and $Ar_3$.

When the steel is a plain carbon steel containing not lower than 0.4% of C or a low alloy steel having a hardenability not lower than that of 0.4% C plain carbon steel, it is preferable to cool the rough-worked steel at a cooling rate higher than 2° C./sec. to a temperature between $Ar_1$ and $Ar_3$ or Arcm.

According to a preferred embodiment of the invention, the annealing treatment is conducted on the same line as that of the hot working of the steel or on in the secondary working line of the steel product.

According to a preferred embodiment of the invention, said annealing treatment comprises the step of:

immediately after the finish working, isothermally maintaining the finish-worked steel at a temperature between ($Ae_1$ minus 100° C.) and $Ae_1$ point for at least 10 minutes.

According to another embodiment of the invention, the annealing treatment comprises the step of:

slowly cooling the finish-worked steel to 500° C. at a cooling rate lower than 100° C., preferably lower than 60° C. per minute.

According to a further embodiment of the invention, the annealing treatment includes the steps of:

cooling the finish-worked steel to a temperature between $Ae_1$ and $Ar_1$;

working the cooled steel with a reduction of at least 15%, thereby to induce the pearlite or bainitic transformation of the steel and simultaneously to raise the temperature of the steel by the heat of mechanical deformation to a temperature between $Ac_1$ and $Ac_3$ or Accm; and, repeating said cooling and working steps.

The finish-worked steel may be cooled down to room temperature and the annealing treatment may be conducted by the usual method of spheroidization.

According to the present invention, the steel may be pretreated, before of the finish woring, by working the steel with a reduction ratio of at least 10% in a temperature range between $Ar_3$ or Arcm and ($Ar_3$ plus 100° C.) or (Arcm plus 100° C.) to thereby make the austenitic grain smaller than 25 μm.

BRIEF DESCRIPTION OF THE DRAWINGS

The present invention will be described in more detail with reference to the accompanying drawings, wherein.

DETAILED DESCRIPTION OF THE INVENTION

Figure 1:
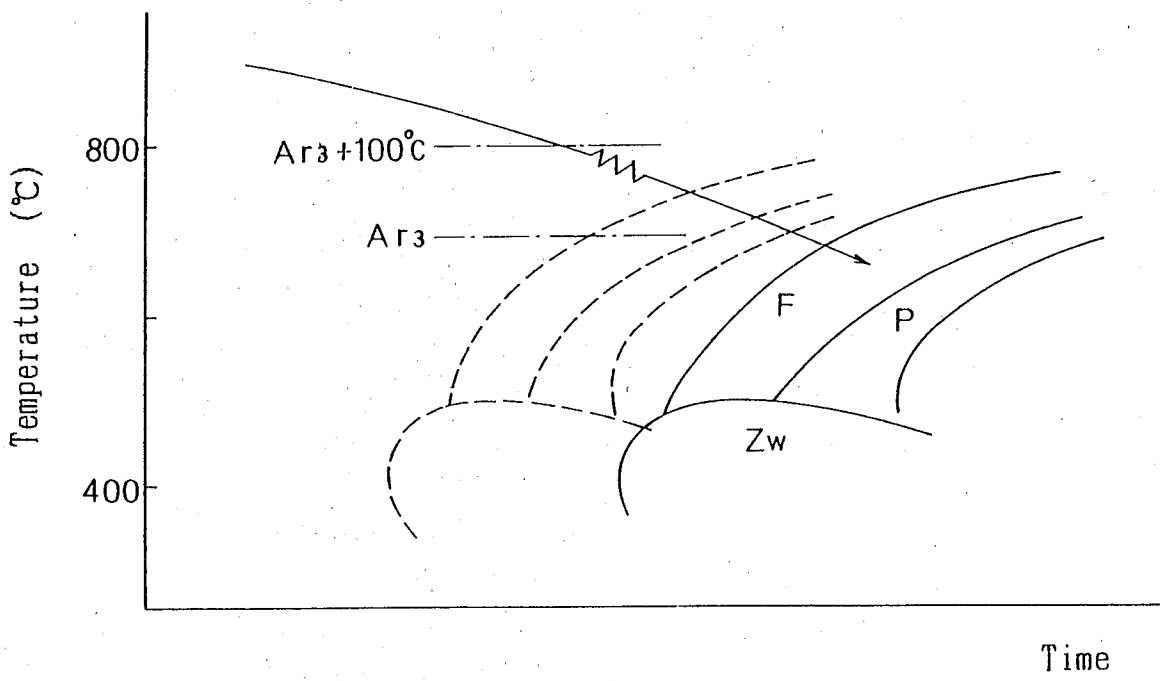
FIG. 1 graphically represent the effect of the pretreatment according to an embodiment of the present invention.

Each step of the process according to the present invention will be explained in detail in the following:

(1) reason for the restriction of the carbon content

In the case of a steel containing more than 2% of c, the austenite range in the transformation chart of the steel is very narrow, and then the amount of the pre-eutectoid cementite or free cementite precipitated in the crystalline boundaries in the course of the hot working is increased, thus causing cracking of the hot worked product.

The steel to which the process of the present invention is applied may contain Si, Mn, Cr Mo, etc as alloying element to provide a desired strength and ductility. The steel may further contain deoxidizing elements such as sol.Al and impurities such as P and S in a restricted amount depending upon the desired mechanical properties and the employed melting method.

As a steel to which the process of the present invention is preferably applied, there are steels S12C, S20C, S45C, Scr435, SCM435, SUJ2 of the JIS. However, the chemical composition of the steel is not the essential part of the present invention, and then the explanation thereof will not be made in this specification.

(2) The reason for heating the steel above the $Ac_1$ point

The heating temperature is decided to be higher than $Ac_1$ point following to the restriction of the temperature range of the finish working which will be explained hereinafter. Further, with a heating of the steel below the $Ac_1$ point, an efficient hot working can not be attained because of the high resistance to deformation of the steel.

(3) The restriction of the temperature range of the finish working

In the temperature range of the finish rolling claimed in this application, that is, the temperature range between $Ar_1$ and $Ar_3$ or Arcm point, the metallurgical structure of the steel consists of dual-phases of metastable austenite and ferrite (pro-eutectoid cementite in the case of a hyper-eutectoid steel). When this metallurgical structure is subjected to a hot working in that temperature range, much of fine ferrite (pro-eutectoid cementite in the case to hyper-eutectoid steel) may be generated in the crystalline boundaries or in the grains of the metastable austenite due to the mechanically induced transformation of the austenite. Thus, the austenitic grains are divided each other by the ferrites which have been precipited by the mechanically induced transformation and the grain size thereof becomes finer.

We discovered after the experiment that the cementite precipitated from the fine austenitic grain is easier to spheroidize than the cementite precipitated from the gross austenitic grain. From this technical view point, the finish working of the steel in the temperature range described in the above is very effective for the spheroidization of cementite.

If the steel is cooled to a temperature lower than the $Ar_1$ point, a lamellar cementite is precipitated in the metastable austenite before the finish working. Therefore, with a finish working at teperatures lower than $Ar_1$, the annealed steel exhibits a high tensile strength and a uniform metallurgical structure can not obtained. Further, the deformed structure remains in the annealed steel and it increases the tensile strength of the steel. Accordingly, the finish working should be conducted at temperatures higher than the $Ar_1$ point.

On the other hand, if the finish working is conducted at temperatures higher than $Ar_3$ or Arcm, the mechanically induced transformation to ferrite or pro-eutectoid cementite would not sufficiently occur and the austenitic grain does not become so fine that the subsequent annealing treatment would not be so effective for the spheroidization of cementite.

In the case of the eutectoid steel, pro-eutectoid cementite, which has been precipitated before the finish working, is mechanically deformed and fragmented in the course of the finish working and the dispersed cementite particles would separately agglomerate with each other in the subsequent spheroidizing treatment to become spheroidal cementite. Dislocations generated in the meta-stable austenite grains become the nuclei for precipitating the spheroidal cementite.

That is, a finish working at temperatures lower than the $Ar_1$ point is ineffective due to the precipitated lamellar cementite, and on the other hand, with a finish working at temperatures higher than $Ar_3$ or Arcm point, the recovery of the mechanically worked matastable austenitic structure immediately occurrs and the dislocations introduced by the hot working disappear.

Because of the two reasons explained in the above, the finish working should be conducted in the temperature range between $Ar_1$ and $Ar_3$ or Arcm.

Further, we discovered that, even if the finish rolling is conducted within the above temperature range, the mechanical properties of the resulting steel product vary depending upon the cooling rate of the rough-rolled steel, that is, the cooling rate of the steel just before the finish rolling. If the cooling rate is lower than a certain value, the deformability of the resulting steel acutely lowers. This critical cooling rate varies depending upon the kind of steel. The higher is the hardenability of the steel, the lower is the critical cooling rate.

Accordingly, the hardenability of the steel should be considered to decide the cooling rate of the steel before the finish rolling as described in the above. The metallurgical reason for this restriction of the cooling rate is as follows:

As explained in the above, the finish rolling within the temperature between $Ar_1$ and $Ar_3$ or Arcm is generally effective for the spheroidization of cementite. However, even within that temperature range, the higher is the finish rolling temperature, the less is the precipitation amount of the ferrite due to the mechanically induced transformation and the easier becomes the recovery of the dislocations which otherwise would be nuclei of the spheroidal cementite. The amount of the mechanically induced ferrite and the recovery of the dislocations are depending upon the hardenability of the steel. The lower is the hardenability of the steel, the higher cooling rate should be taken.

Accordingly, in order to obtain a uniform dispersion of cementite and then to improve the deformability of the resulting steel product, the cooling rate should be chosen in conformity with the hardenability of the steel.

Further it should be noted that, in the present invention, the temperature range is defined in terms of the transformation temperatures under the cooling condition. To the contrary, in the prior art disclosed in Japanese patent Laid-open No. 27926/1983, it is defined in the terms of the temperatures in the equilibrium condition, which makes the process impractical or very difficult to conduct precisely.

In the process disclosed in Japanese patent Laid-open No. 27926/1984, the working is conducted in a temperature range between ($Ae_3$ minus 20° C.) and ($Ae_1$ minus 30° C.). For the steels preferably applicable to the present invention such as S12C, S20C, S45C, SCr435, SCM435 and SUJ2 of the JIS, this temperature range situates above the $Ar_3$ point of the steel. Therefore, according to the process disclosed in this Japanese patent Laid-open, one can not obtain a steel having a good spheroidal structure of cementite.

(4) Reason for restriction of the reduction ratio in the finish working

According to the present invention, the hot working of at least 20% should be made in the above-mentioned temperature range.

The higher is the reduction ratio in the finish rolling within that teperature range, the more effective is the spheroidization of cementite in the subsequent annealing treatment. That is, with a hot working of the steel in that temperature range, the refinement of the metastable austenite and the introduction of dislocations are promoted, which renders the spheroidizing treatment easier and more effective. To the contrary, with a reduction of less than 20%, the above effect can not be attained sufficiently and the lamellar cementite tends to readily precipitate.

Meanwhile, the temperature of the steel product is raised due to the heat of mechanical deformation. But the temperature of the steel should be preferably maintained to lower than the $Ac_3$ point also during the finish rolling.

The reduction ratio used in this specification means the ratio of reduction in sectional area. In the case of multi paths rolling, the reduction means the total reduction ratio of all the paths.

The cooling of the rough-rolled steel to the starting temperature of the finish rolling may be conducted by water cooling, mist cooling, air cooling (that is, forcible air cooling), natural air cooling (that is, by leaving the steel to cool down by the natural air) and by laying the steel on the laying zone to cool down naturally.

(5) The pretreatment

According to an embodiment of the present invention, the steel to be finish worked is subjected to a pretreatment, which comprises;

working the steel with a reduction of at least 10% within a temperature range between $Ar_3$ or Arcm and ($Ar_3$ plus 100° C.) or (Arcm plus 100° C.), thereby making the grain size to lower than 25 μm, in which ferrite or pro-eutectoid cementite will be precipitated in the course of the subsequent finish working of the steel.

This pretreatment exerts the following two technical effects:

The first effect is that, as shown in FIG. 1, the CCT curve of the steel is shifted to the side in which the transformation will occur for a shorter time, that is, to the left side viewing in FIG. 1. This shift of the CCT curve is due to a mechanically induced transformation of $A_3$ or Acm (of austenite to ferrite or cementite), and it is effective for promoting the $A_1$ transformation, that is, for the precipitation of spheroidal cementite in the course of the subsequent annealing treatment such as the isothermal treatment, slow cooling treatment, etc. In FIG. 1, the solid line indicates the CCT curve in the case the pretreatment is not conducted and the broken line indicates the shifted one because of the pretreatment of the present invention.

The second effect is that the pretreatment induces the recrystallization of austenite which is effective also for the improvement of the spheroidization in the subsequent annealing step.

If the pretreatment is conducted with a reduction of less than 10%, the grain size of the austenite will not become lower than 25 μm, and then the desired improvement in spheroidization in the subsequent annealing treatment is not attained.

If the pretreatment is conducted at temperatures below $Ar_3$ or Arcm, the metallurgical structure of the steel is not maintained at a single phase of austenite. On the other hand, if the pretreatment is conducted at temperatures higher than ($Ar_3$ plus 100° C.) or (Arcm plus 100° C.), the grain size of the austenite of the steel does not become lower than 25 μm.

(6) The annealing treatment

Subsequent to the finish working of the steel described in the above, the steel is annealed by any one of the following treatments:

(a) The isothermal treatment

The finish worked steel may be annealed by isothermally maintaining the same within a temperature range between ($Ae_1$ minus 100° C.) and $Ae_1$ for at least 10 minutes.

If the isothermal treatment is conducted at temperatures above the $Ae_1$ point, the transformation $A_1$, that is, the transformation of austenite to cementite does not occur. Thus, the treatment should be conducted below $Ae_1$ point. However, the lower is the temperature at which the isothermal treatment is conducted, the more difficult does the spheroidization of cementite become. Particularly, if the treatment is conducted at a temperature below ($Ae_1$ minus 100° C.), cementite would be precipitated in a lamellar form. Accordingly, the isothermal treatment should be conducted within a temperature range between ($Ae_1$ minus 100° C.) and $Ae_1$.

If the time duration is shorter than 10 minutes, the spheroidization of cementite is not completed. Thus, it is decided for at least 10 minutes.

(b) The slow cooling treatment

The finish-worked steel may be annealed by slowly cooling the steel to 500° C. at a cooling rate lower than 100° C. per minute, preferably lower than 60° C. per minute.

If the slow cooling is conducted at a cooling rate higher than 100° C. per minute, lamellar cementite tends to precipitate. A cooling rate lower than 60° C. per minute is preferable for obtaining an elevated spheroidization ratio of cementite.

The slow cooling of the steel should be conducted to lower than 500° C. at which precipitation of the spheroidal cementite is completed. When it is desired to shorten the time duration of the slow cooling treatment, the slow cooling of the steel may be stopped at 600° C. at which most of the precipitation of cementite is finished.

(c) The repeating treatment

The finish-rolled steel may be annealed by the repeating treatment as mentioned in the above.

This treatment utilizes the heat of mechanical deformation for raising the temperature of the steel. In this treatment, an elevated spheroidizing ratio of cementite is obtained by the effect of the repetition of the cooling and heating of the steel and by the effect of mechanical deformation of the carbides.

The repeating treatment of the present invention is different from the prior art disclosed in the Japanese patent Laid-open No. 8586/1983 in that the cooling is conducted to a temperature between $Ar_1$ and $Ae_1$. In the repeating treatment of the present invention, the cooling temperature is relatively high, and therefore the steel presents a metallurgical structure of a single phase of austenite or mixed phase of austenite and ferrite or cementite when the hot working is started. The resistance to deformation of the steel in such metallurgical structure is relatively low, and the working of the steel can be smoothly conducted.

In this embodiment of the invention, the conditions of the repeating treatment are decided by the following reasons;

1. The cooling temperuature of the steel

As described in the above, it has been well known that the mechanical deformation of the carbides is very effective for performing the spheroidization of cementite. The repeating treatment of the present invention utilizes also the effect of the mechanical deformation of the carbides.

That is, while the mechanical deformation was conducted in cold condition in the prior art, in the repeating treatment of the present invention, it is conducted by the hot working at that temperature range.

In order to attain the effect of the mechanical deformation, the carbides should be already precipitated when the pretreatment is started. On the other hand, if the bainite transformation or pearlite transformation is completed at the time of the hot working, the resistance to deformation of the steel is so high that the load applied to the working machine such as rolling mill becomes too high. Accordingly, the temperature range of the cooling step of the repeating treatment of the present invention is decided so that the steel presents a metallurgical structure of the single phase of austenite or of the mixed phase of austenite and ferrite or cementite at the start of the hot working of the pretreatment. In this case, the austenite is a super-cooled austenite in which carbides would be precipitated by the mechanically induced transformation in the course of the hot working. Therefore, in the pretreatment of the invention, the hot working is conducted while the carbides being precipitated, thereby attaining sufficiently the mechanical deformation of the carbides.

Accordingly, the temperature of the cooling is decided as between $Ae_1$ and $Ar_1$ which corresponds to the super-cooled austenite range.

2. Reduction ratio in section in the hot working

The hot woking should be conducted with a reduction ratio of at least 15% by the following reasons:

Firstly it is necessary to raise the temperature of the steel to higher than the $Ac_1$ point by the heat of mechanical deformation.

Secondary, it is necessary to perform a sufficient mecahnical deformation of the carbides.

In this hot working also, the working may be conducted by only one path through the working machine or multiple paths therethrough.

3. Reason for the repetition of the cooling and the hot working

As described in the above, there has been well known a repetitious treatment for the spheroidization of cementite. The principle of this method is that the steel is cooled down to lower than $A_1$ point to precipitate the carbides, and then the steel is heated to higher than $A_1$ point to dissolve a portion of the carbides, thus dividing the carbides. The repetition of such cooling and heating results in a complete spheroidal cementite.

If the temperature of the steel is raised to higher than $Ac_3$ or Accm, the carbides tend to dissolve completely. Accordingly, the hot working of the steel should be controlled so that the temperature of the worked steel is raised to between $Ac_1$ and $Ac_3$ or Accm.

These cooling and heating during the working must be repeated at least two times for substantially attaining the effect thereof.

(d) The usual annealing treatment in other process line

When the finish-worked steel is left to cool down naturally to room temperature, the cementite is partially spheroidized. Such cooled steel may be treated by the usual annealing method on a separate line. In this case, the necessary time for annealing treatment is shorter than that in the prior art.

APPARATUS PREFERABLY EMPLOYED FOR CONDUCTING THE PROCESS OF THE INVENTION

An apparatus employed for conducting the process of the invention will be described with reference to the accompanying drawings.

Figure 2:
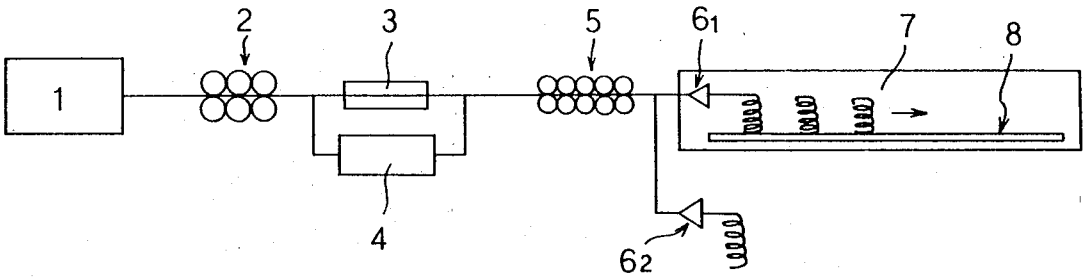
FIG. 2 shows diagrammatically a hot rolling line of the steel wire which is preferably employed to conduct the process according to the present invention.

Referring to FIG. 2, reference numeral 1 designates a heating furnace and numeral 2 designates a rough rolling mill which is connected to the heating furnace 1. The production line further comprises a water, mist or air cooling means 3 and a laying zone 4 in the downstream of the rough rolling mill 2. As shown in FIG. 2, the cooling means 3 and the laying zone 4 are arranged in parallel to each other.

The production line further comprises a finish rolling mill 5, downstream of which coiling means $\mathbf{6_1}$ and $\mathbf{6_2}$ are disposed in parallel to each other. The coiling means $\mathbf{6_1}$ supplys a steel wire in the form of a coil into a continuous furnace 7, in which the coil of the steel wire is transferred by means of a conveyer 8. The continuous furnace may be an isothermal heating furnace or a slow cooling furnace.

In case the annealing treatment is conducted on a separate line, the steel wire is coiled by the coiler $\mathbf{6_2}$ and transferred to the other line.

Figure 3:
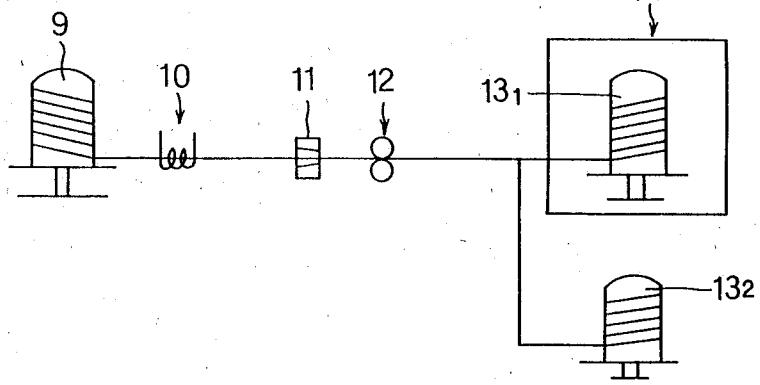
FIG. 3 show diagrammtically a secondary working line for the steel wire which is preferably employed for conducting the process according to the present invention.

FIG. 3 shows a secondary working line on which the process of the present invention is conducted.

The secondary working line comprises a pay-off reel 9 for uncoiling a steel wire, a high-frequency heating means 10 for heating the wire to a desired temperature and a die 11 through which the wire is drawn by a pinch-roller 12. The production line further comprises coilers $\mathbf{13_1}$ and $\mathbf{13_2}$ which are arranged to each other in parallel.

The coiler $\mathbf{13_1}$ is disposed in a furnace 14 which may be an isothermal furnace or a slow cooling furnace. In case the isothermal treatment or slow cooling treatment is conducted on the secondary production line, the coiler $\mathbf{13_1}$ is employed.

In case the annealing treatment is conducted on a separate line by a usual spheroidizing annealing treatment, the wire is coiled by the coiler $\mathbf{13_2}$ and then transferred to the other line.

Figure 4:
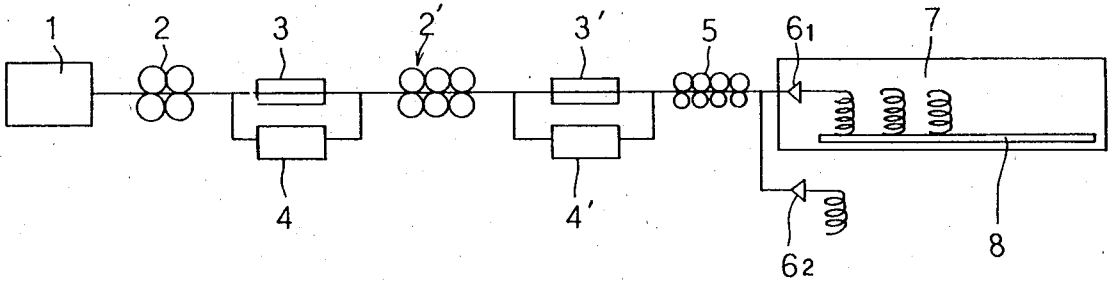
FIG. 4 shows diagrammtically a hot rolling line of the steel wire which is preferably employed for conducting a preferred embodiment of the present invention.
Figure 5:
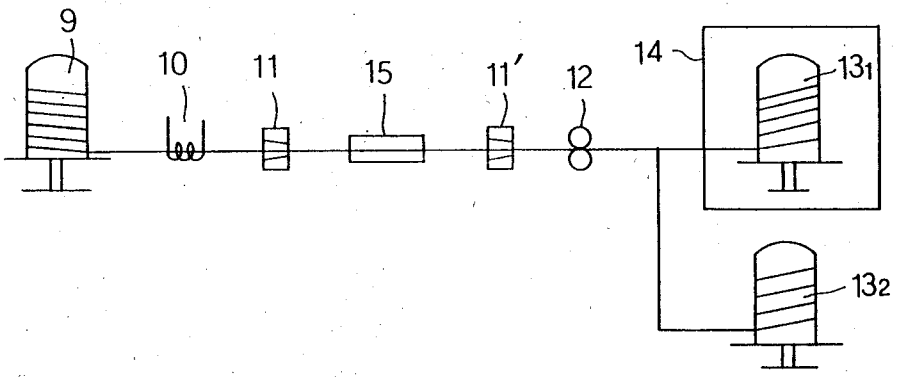
FIG. 5 shows diagrammatically a secondary working line for the steel wire which is preferably employed for conducting a preferred embodiment of the present invention.

FIGS. 4 and 5 show respectively a production line of a steel bar and a secondary production line of a steel wire which are preferably employed for conducting a preferred embodiment of the present invention.

In FIGS. 4 and 5, the means corresponding to those shown in FIGS. 2 and 3 are indicated by the same reference numerals, and only the portions which are different from those shown in FIGS. 2 and 3 will be explained in the following.

The production line shown in FIG. 4 further comprises an intermediate rolling mill 2' downstream of the cooling means 3 and the laying zone 4, and a second group of water, mist or air cooling means 3' and the laying zone 4' which are arranged in parallel to each other.

In this production line, the steel heated by the furnace 1 is rough rolled by the rough rolling mill 2, and then air, mist or water cooled by the means 3 to a temperature range between $Ar_3$ or Arcm and ($Ar_3$ plus 100° C.) or (Arcm plus 100° C.). The rough-rolled steel may be laid on the laying zone 4 to cool down naturally to said temperature range. Within this temperature range, the rough-rolled steel is rolled with a reduction of at least 10% by means of the intermediate rolling mill 2' to thereby make the grain size of austenite to smaller than 25 μm before the precipitation of cementite to proeutectoid ferrite. Subsequently, the steel is air, mist or water cooled down by means of cooling means 3' or left to be laid in the laying zone 4' to naturally cool down to a temprature range between $Ar_1$ and $Ar_3$ (Arcm). The cooled steel is then finish rolled by the finish rolling mill 5 with a reduction of at least 20%. The finish-rolled steel is subjected to an annealing treatment as already explained in the above with reference to FIG. 2.

In the secondary working line shown in FIG. 5, there is disposed a water, mist or air cooling means 15 downstream of the die 11 and further a drawing die 11' upstream of the pinch-roller 12. In this working line, the steel heated by the heating means 10 is drawn through the die 11 within a temperature range between $Ar_3$ or Arcm and ($Ar_3$ plus 100° C.) or (Arcm plus 100° C.) to thereby make the grain size of the austenite to smaller than 25 μm. The steel is then water, mist or air cooled by the cooling means 15 to a temperature range between $Ar_1$ and $Ar_3$ (Arcm) and drawn through the die 11' within the temperuature range.

The present invention will be explained with reference to the Examples, which are simple illustration of the invention but do not restrict the scope of the invention.

GROUP I OF THE EXAMPLES

Example 1

Steel bars of 60ϕ mm diameter each having a chemical compostion shown in Table 1 were rolled to a diameter of 35 mm and then cooled respectively at a cooling rate shown in Table 2 to a temperature between 660° to 670° C. Subsequently, the steels were finish rolled to a diameter of 20ϕ mm (with a reduction ratio of 67%) and immediately coiled in a continuous furnace. In the furnace, the coils of the steels were isothermally maintained at 700° C. for 30 minutes.

The mechanical and metallurgical properties such as the tensile strength, reduction of area, threshold limit compressibility and spheroidizing ratio of the resulting steel are shown in Table 2. Particularly, the spheroidizing ratio was measured by counting the numbers of the cementites which have a ratio of larger diameter to smaller diameter higher than 3.0 and calculating its percentage to the cementites observed in the microscopic structure of the specimen.

The transformation temperatures $Ae_1$, $Ae_3$ or Aecm were measured by means of the Formaster test machine for thermal expansion. The transformation temperatures $Ar_1$, $Ar_3$ or Arcm were measured by heating a steel bar of 35ϕ mm diameter to 900° C. and cooling them at various cooling rates. That is, the steels of S12C and S20C were respectively water cooled and forcibly air cooled, and the other steels were left to naturally cool down. These transformation temperatures thus determined are indicated also in Table 1.

From the results shown in Table 2, it is understood that a cooling rate higher than 250°/sec (water cooling) for the steel S12C, a cooling rate higher than 15° C./sec (forcible air cooling) for the steel S20C and a cooling rate higher than 3° C./sec (natural cooling) for the steel S45C are effective for improving the spheroidizing property and the deformability of the resulting steels.

specimens of S12C and S20C were cooled respectively by water cooling and forcible air cooling, and the other specimens were left to cool down naturally to the respective starting temperature of the finish rolling.

The cooled steels were then finish rolled within a predetermined temperature range. The finish-rolled steels were subjected to the various annealing treatment.

The mechanical properties and metallurgical properties such as the tensile strength, reduction of area, threshold limit compressibility and the spheroidizing ratio of cementite were measured.

Example 2

The steels shown in Table 1 were rough rolled to 35ϕ mm and cooled respectively to the starting temperature of the finish rolling indicated in Table 3. The cooled steels were then finish rolled to a diameter of 20ϕ mm (with a reduction ratio of 67%) and immediately coiled in a furnace maintained at 700° C. and isothermally maintained for 30 minutes.

The properties of the resulting steels are indicated in Table 3.

TABLE 1

| Steel No. | Indication of JIS | Chemical composition (%) C | Si | Mn | P | S | Cr | Mo | Sol. Al | $Ae_1$ (°C.) | $Ae_3$ or Aecm (°C.) | $Ar_1$ (°C.) | $Ar_3$ or Arcm (°C.) |
|---|---|---|---|---|---|---|---|---|---|---|---|---|---|
| A | S20C | 0.21 | 0.25 | 0.70 | 0.018 | 0.012 | — | — | 0.028 | 731 | 815 | 645 | 701 |
| B | S45C | 0.44 | 0.23 | 0.65 | 0.013 | 0.011 | — | — | 0.033 | 727 | 776 | 639 | 696 |
| C | SCr 435 | 0.35 | 0.30 | 0.72 | 0.015 | 0.012 | 1.02 | — | 0.025 | 740 | 793 | 610 | 685 |
| D | SCM 435 | 0.36 | 0.28 | 0.75 | 0.010 | 0.011 | 0.99 | 0.18 | 0.037 | 742 | 790 | 603 | 675 |
| E | SUJ2 | 1.00 | 0.27 | 0.36 | 0.013 | 0.008 | 1.34 | — | 0.035 | 745 | 814 | 610 | 681 |
| F | S12C | 0.12 | 0.22 | 0.59 | 0.012 | 0.008 | — | — | 0.020 | 732 | 880 | 627 | 705 |

TABLE 2

| Specimen No. | Indication of JIS | Cooling rate (°C./sec) | Starting temperature of Finish working (°C.) | Properties T.S. kg f/mm² | R.A. (%) | L.C. (%) | S.R. (%) | NOTE |
|---|---|---|---|---|---|---|---|---|
| 1 | S12C | 3 | 660 | 45 | 70 | 76 | 82 | |
| 2 | | 15 | 660 | 44 | 75 | 72 | 84 | |
| 3 | | 40 | 660 | 42 | 76 | 75 | 86 | |
| 4 | | 250 | 660 | 42 | 82 | 84 | 93 | Invention |
| 5 | S20C | 3 | 670 | 49 | 72 | 70 | 76 | |
| 6 | | 15 | 670 | 45 | 78 | 84 | 92 | Invention |
| 7 | | 40 | 670 | 44 | 79 | 85 | 90 | Invention |
| 8 | | 250 | 670 | 44 | 78 | 85 | 90 | Invention |
| 9 | S45C | 3 | 670 | 53 | 65 | 70 | 94 | Invention |
| 10 | | 15 | 670 | 53 | 65 | 69 | 95 | Invention |
| 11 | | 40 | 670 | 53 | 64 | 69 | 94 | Invention |
| 12 | | 250 | 670 | 54 | 66 | 70 | 94 | Invention |

T.S.: Tensile Strength
R.A.: Reduction of Area
L.C.: Threshold Limit Compressibility
S.R.: Spheroidizing RATIO

GROUP II OF THE EXAMPLES

In this group of examples, steel specimens each having a chemical composition shown in Table 1 and a diameter 60ϕ mm were processed on a production line as shown in FIG. 2. That is, the steel specimens were heated to 900° C. and then rough rolled and cooled to a predetermined temperature. More specifically, the Further, an experiment was conducted with steel S45C by varying the starting temperature of the finish rolling. The results are shown in FIG. 6.

Figure 6:
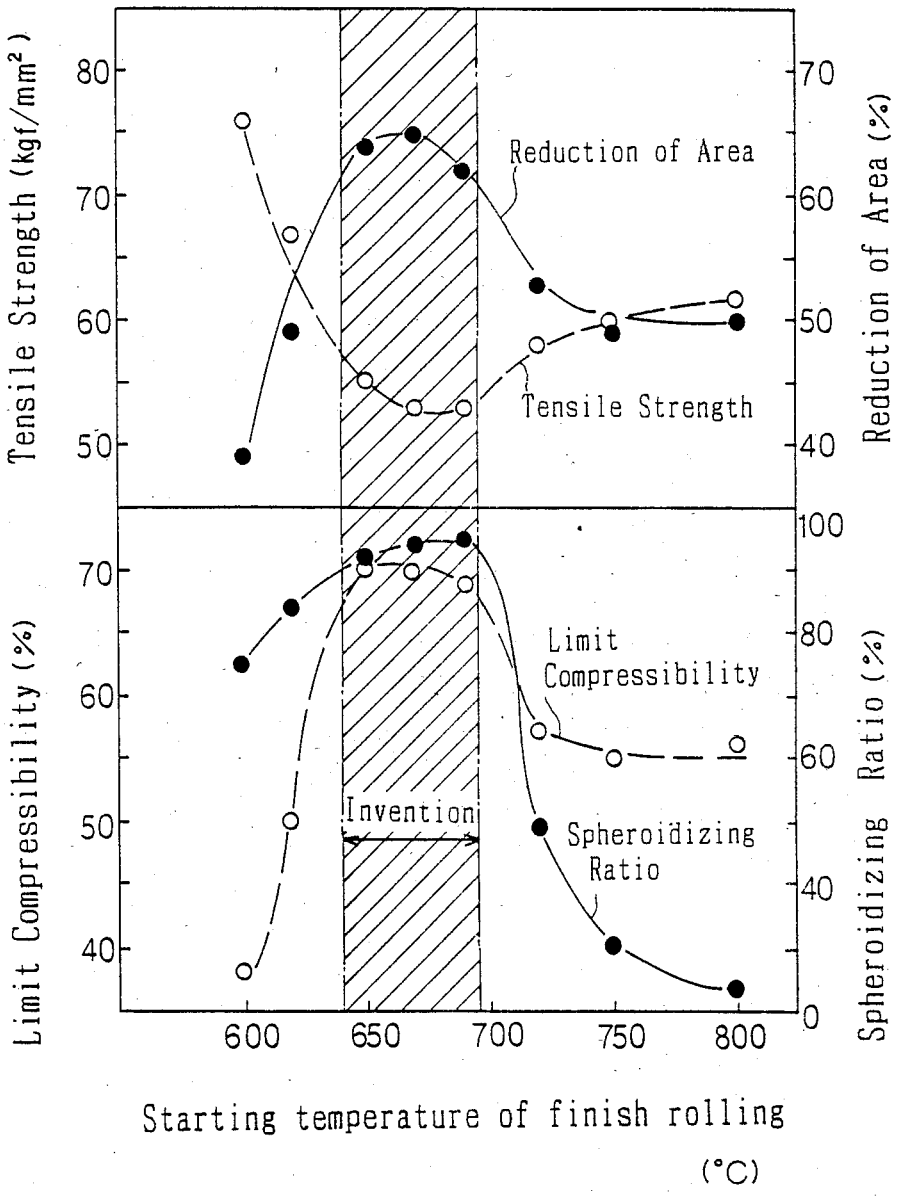
FIGS. 6 to 10 show respectively the results of the Examples of Group II.

It is understood from the results shown in Table 3 and FIG. 6 that the steels finish-rolled within the temperature range of the present invention exhibit improved mechanical and metallurgical properties.

TABLE 3

| Specimen No. | Indication of JIS | Starting temperature of Finish working (°C.) | Tensile Test T.S. kg f/mm² | R.A. (%) | L.C. (%) | S.R. (%) | NOTE |
|---|---|---|---|---|---|---|---|
| 13 | S20C | 720 | 50 | 65 | 62 | 54 | |
| 14 | | 690 | 48 | 78 | 78 | 89 | Invention |
| 15 | | 670 | 45 | 78 | 84 | 92 | Invention |
| 16 | | 650 | 46 | 77 | 80 | 85 | Invention |
| 17 | | 620 | 58 | 60 | 53 | 71 | |
| 18 | S45C | 720 | 58 | 53 | 57 | 49 | |
| 19 | | 690 | 53 | 62 | 69 | 90 | Invention |
| 20 | | 670 | 53 | 65 | 70 | 94 | Invention |
| 21 | | 650 | 55 | 64 | 70 | 92 | Invention |
| 22 | | 620 | 67 | 49 | 50 | 84 | |
| 23 | SCr 435 | 700 | 58 | 50 | 60 | 63 | |
| 24 | | 670 | 55 | 68 | 68 | 88 | Invention |
| 25 | | 650 | 52 | 70 | 72 | 98 | Invention |
| 26 | | 620 | 56 | 68 | 70 | 94 | Invention |
| 27 | | 590 | 70 | 47 | 48 | 78 | |
| 28 | SCM 435 | 700 | 62 | 59 | 49 | 70 | |
| 29 | | 670 | 54 | 72 | 65 | 91 | Invention |
| 30 | | 650 | 54 | 75 | 70 | 97 | Invention |
| 31 | | 620 | 55 | 74 | 68 | 94 | Invention |
| 32 | | 590 | 73 | 54 | 45 | 79 | |
| 33 | SUJ2 | 700 | 70 | 51 | 50 | 72 | |
| 34 | | 670 | 64 | 62 | 59 | 97 | Invention |
| 35 | | 650 | 63 | 65 | 60 | 99 | Invention |
| 36 | | 620 | 66 | 62 | 58 | 98 | Invention |
| 37 | | 590 | 83 | 39 | 37 | 90 | |
| 38 | S12C | 710 | 47 | 72 | 69 | 47 | |
| 39 | | 680 | 43 | 78 | 80 | 85 | Invention |
| 40 | | 660 | 42 | 82 | 84 | 93 | Invention |
| 41 | | 630 | 43 | 80 | 83 | 89 | Invention |
| 42 | | 610 | 49 | 70 | 62 | 78 | |

Example 3

The steel S45C was rough rolled to 35ϕ mm and naturally cooled to the starting temperature indicated in Table 3. The finish rolling was conducted by varying the reduction ratio, that is, with 11% (to 33ϕ mm), with 27% (30ϕ mm), with 49% (to 25ϕ mm), with 67% (20ϕ mm) and with 82% (15ϕ mm). These finish-rolled steels and the steel as rough-rolled condition (without finish rolling) were coiled in the furnace and isothermally maintained at 700° C. for 30 minutes.

Figure 7:
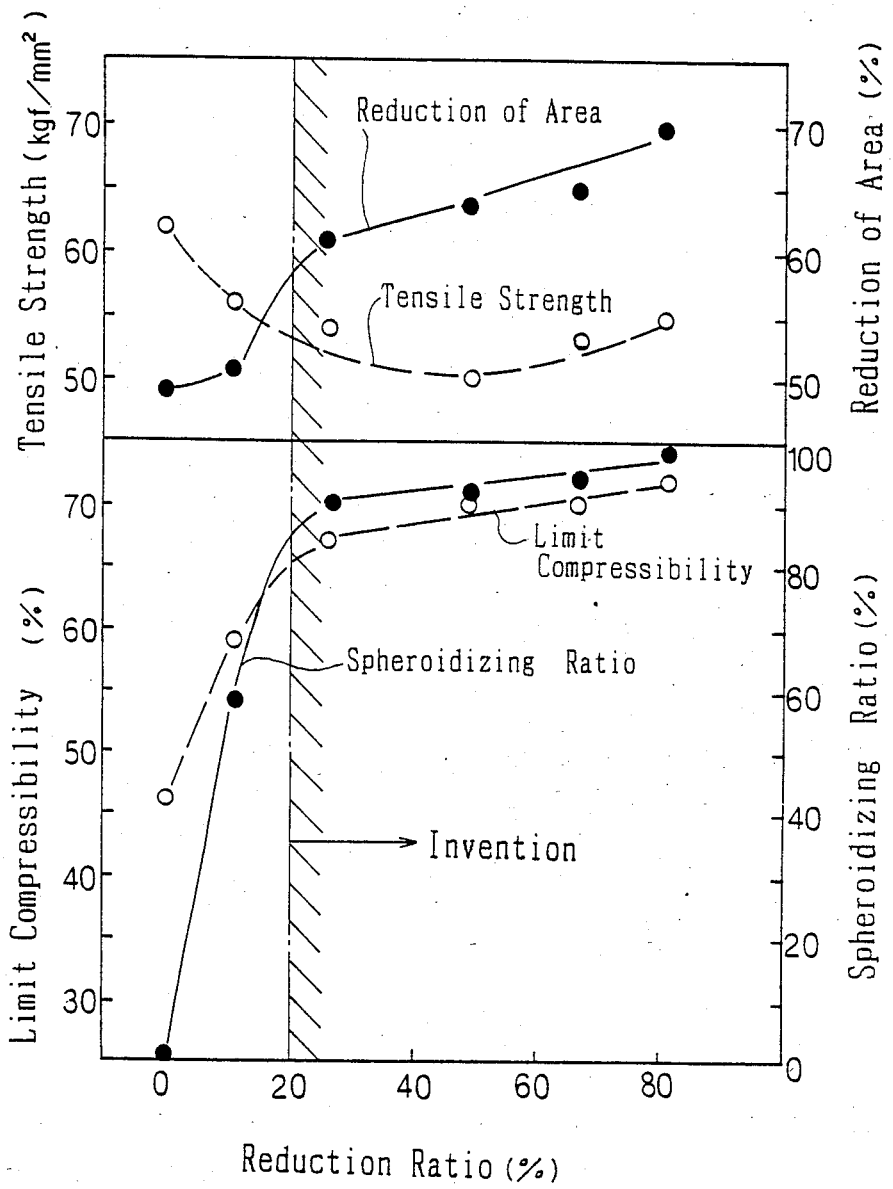

The mechanical and metallurgical properties of the resulting steel are shown in FIG. 7. It is understood from FIG. 7 that the annealed steel which have been finish rolled according to the present invention exhibits a lower tensile strength and improved reduction of area, threshold limit compressibility and spheroidizing ratio. It should be noted that the threshold limit compressibility and the spheroidizing ratio were acutely degraded when the finish rolling was conducted outside the scope of the present invention.

Example 4

The steels S45C and SCM435 were rolled respectively under the same condition as specimen No. 20 (the starting temperature of the finish rolling being 670° C.) and specimen No. 30 (the starting temperature of the finish rolling being 650° C.) to a diameter 20ϕ mm, and then isothermally maintained by varying the time duration of the isothermal treatment from 0 to 40 minutes. The tensile strength and the spheroidizing ratio of the resulting steels are shown in FIG. 8.

Further the finish-rolled steel of the specimen S45C was isothermally treated for 30 minutes by varying the isothermal temperature from 550° C. to 750° C. The tensile strength and the spheroidizing ratio of the resulting steels are shown in FIG. 9.

Figure 8:
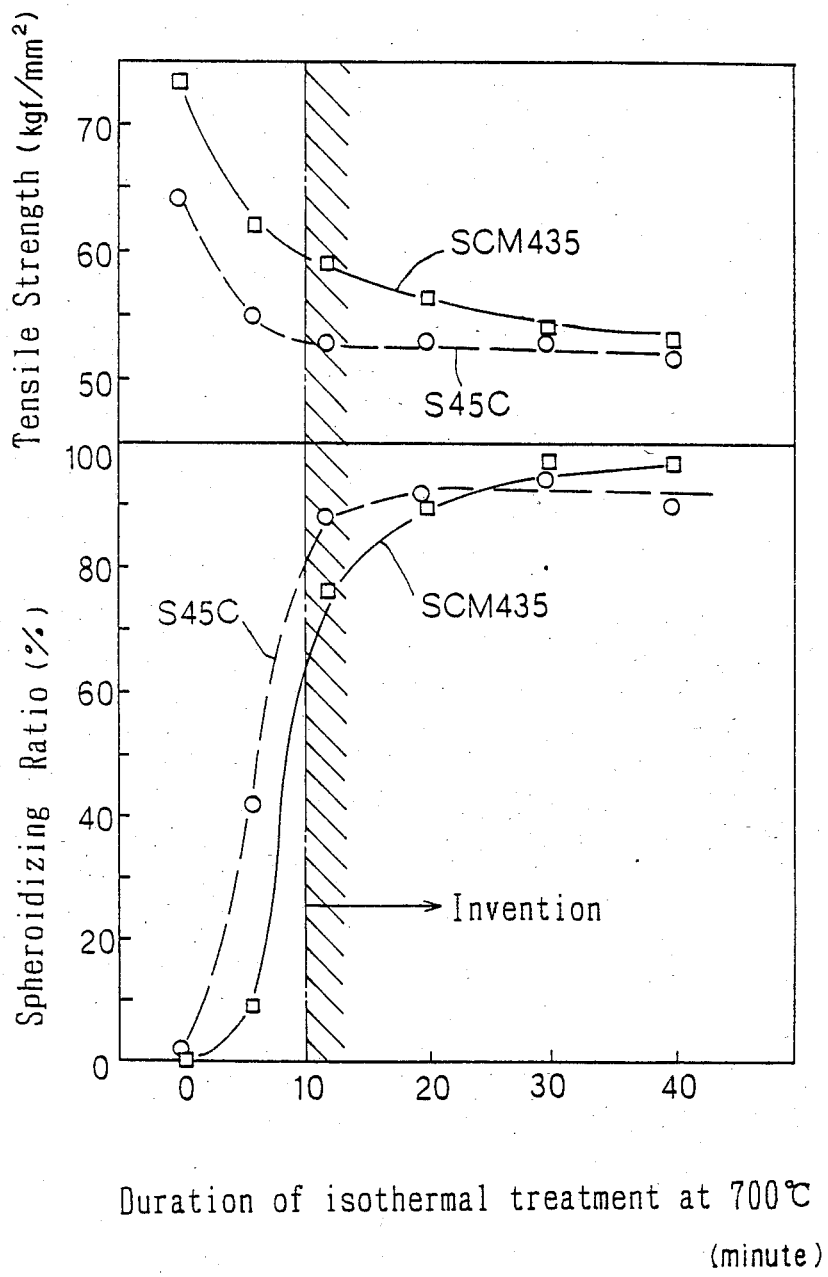
Figure 9:
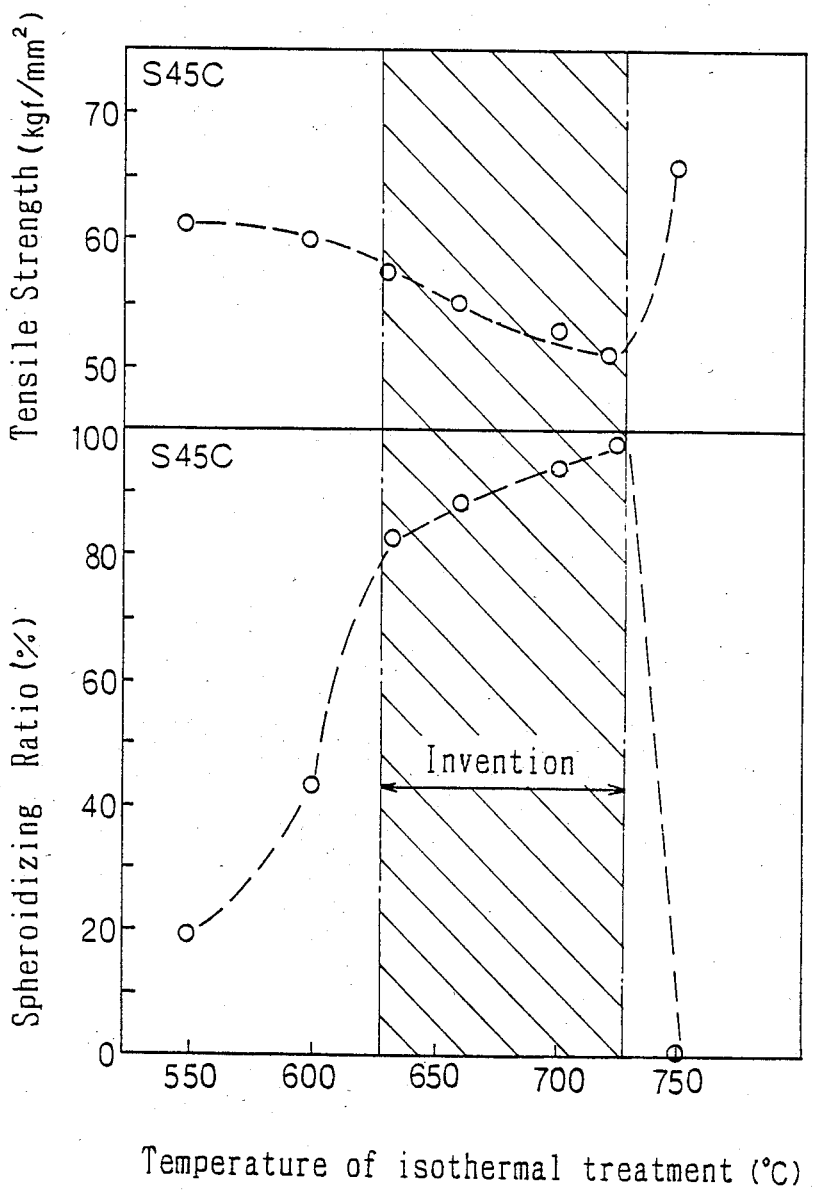

It is understood from FIGS. 8 and 9 that the steels isothermally treated within the temperature range and for the time duration according to the present invention exhibit a lower tensile strength and an elevated spheroidizing ratio of cementite.

Example 5

The steels S45C and SCM435 were rolled respectively under the same condition as specimen No. 20 (the starting temperature of the finish rolling being 670° C.) and specimen No. 30 (the starting temperature of the finish rolling being 650° C.) to a diameter of 20ϕ mm, and then subjected to the slow cooling treatment by slowly cooling the same to 500° C. at various cooling rates from 15° C./min. to 100° C./min., while transferring the same in the continuous furnace. The tensile strength and the spheroidizing ratio of the resulting specimens are shown in FIG. 10.

Figure 10:
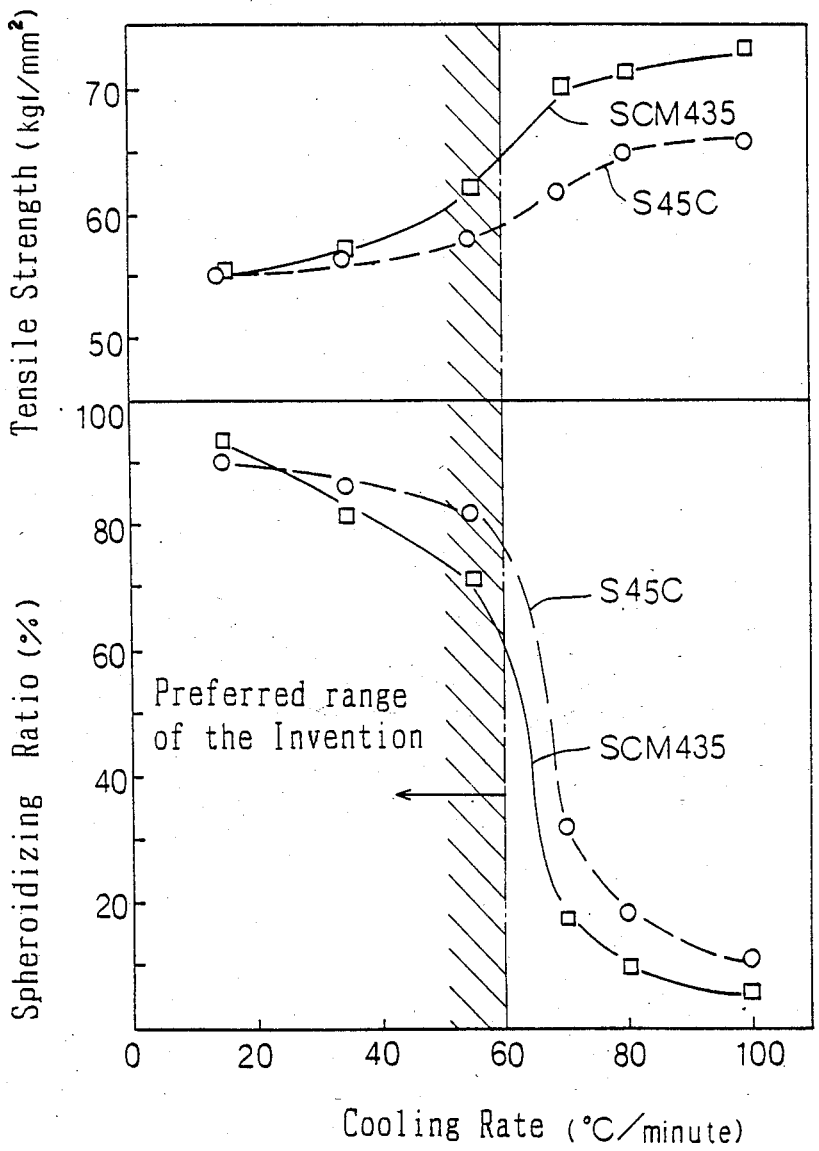

It is understood from FIG. 10 that if the finish-rooled steels were cooled at a cooling rate lower than 60° C./min., steels having a lower tensile strength and an improved spheroidizing ratio of cementite are obtained.

Example 6

The steels S45C and SCM435 were rolled respectively under the same condition as specimen No. 20 (the starting temperature of the finish rolling being 670° C.) and specimen No. 30 (the starting temperature being 650° C.) to a diameter of 20ϕ mm, and then coiled and left to cool down to room temperature. At the same time, steels of S45C and SCM435 were hot worked according to the prior art process and left to cool down naturally to room temperature for comparison.

Figure 11:
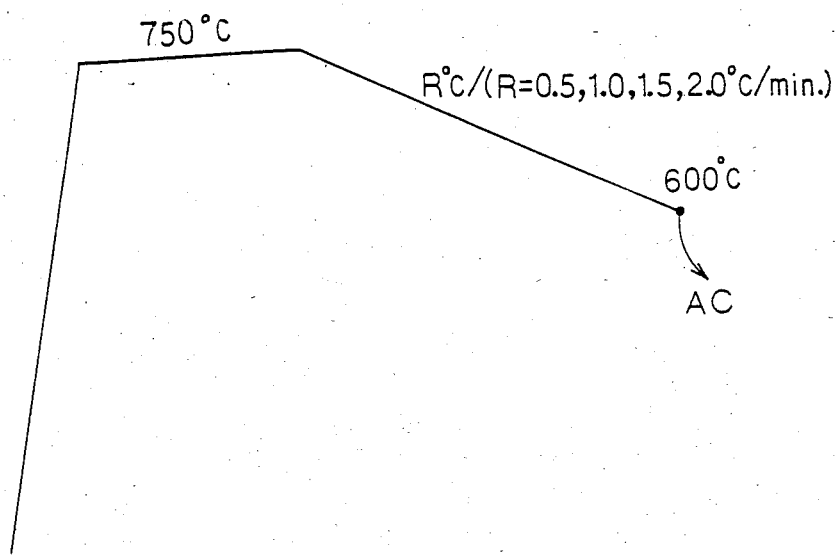
FIG. 11 shows a heat pattern of the spheroidizing treatment conducted in an example of the present invention.

These specimens were subjected to a spheroidizing annealing treatment of which heat pattern is shown in FIG. 11. That is, the spheroidizing annealing treatment was conducted by heating the steels to 750° C. and maintaining the same at 750° C. for 1 hour, and then slowly cooling them up to 600° C. by varying the cooling rate R from 0.5 to 2° C./min..

The mechanical and metallurgical properties of the resulting steels are shown in Table 4. It is understood from Table 4 that the specimens hot worked according to the present invention exhibit an improved spheroidizing property even by the usual spheroidizing annealing treatment.

TABLE 4

| Indication of JIS | Cooling rate in annealing treatment (°C./min.) | Tensile Test T.S. kg f/mm$^2$ | R.A. (%) | L.C. (%) | S.R. (%) | NOTE |
|---|---|---|---|---|---|---|
| S45C | 0.5 | 51 | 64 | 75 | 90 | Invention |
| | 1.0 | 53 | 65 | 75 | 93 | Invention |
| | 1.5 | 55 | 62 | 71 | 89 | Invention |
| | 2.0 | 56 | 60 | 69 | 84 | Invention |
| | 0.5 | 58 | 54 | 58 | 65 | Comparison |
| | 1.0 | 62 | 52 | 55 | 60 | Comparison |
| | 1.5 | 64 | 52 | 55 | 60 | Comparison |
| | 2.0 | 64 | 50 | 53 | 53 | Comparison |
| SCM 435 | 0.5 | 55 | 74 | 73 | 98 | Invention |
| | 1.0 | 55 | 72 | 70 | 96 | Invention |
| | 1.5 | 57 | 69 | 71 | 92 | Invention |
| | 2.0 | 58 | 70 | 66 | 88 | Invention |
| | 0.5 | 62 | 68 | 55 | 85 | Comparison |
| | 1.0 | 65 | 65 | 51 | 84 | Comparison |
| | 1.5 | 65 | 64 | 50 | 80 | Comparison |
| | 2.0 | 67 | 59 | 50 | 75 | Comparison |

GROUP III OF THE EXAMPLES

In this group of the examples, the effect of the pretreatment of the invention was examined.

In each example of this group, steel specimens shown in Table 1 were processed on the production line shown in FIG. 4. That is, each specimen was heated to 900° C. and rough rolled by rough rolling mill 2 from 60ϕ mm to 35ϕ mm. The rough-rolled steels were left to cool down to a predetermined temperature and rolled by the intermediate mill 2' to 30ϕ mm. The steels were then water cooled to a predetermined temperature and finish rolled. The finish-rolled steel was subjected to any one of the annealing treatments according to the embodiment of the present invention.

The tensile strength, reduction of area, threshold limit compressibility and spheroidizing ratio of the resulting steels were measured in the same manner as that of the Examples of group I.

Example 7

With respect to the steels of S45C and SCM435 shown in Table 1, the intermediate rolling was conducted from 35ϕ mm to 30ϕ mm (the reduction ratio being 27%), and the water cooling was conducted up to 670° C. for the steel of S45C and up to 650° C. for the steel SCM435. Then, the finish rolling was conducted up to a diameter of 20ϕ mm. The finish-rolled steels were coiled in a furnace in which the steels were maintained for 20 minutes at 700° C. As shown in Table 5, the starting teperature of the intermediate rolling was varied between 850° C. and 710° C. for the steel of S45C and between 850° C. and 690° C. for the steel of SCM435 in order to examine the effect of the temperature range of the intermediate rolling.

The mechanical and metallurgical properties such as the tensile strength, reduction of area, threshhold limit compressibility and the spheroidizing ratio of cementite were measured.

The intermediate rolling was conducted under the same condition as the above and then the steel were water quenched to measure the austenitic grain size at the time of completion of the intermediate rolling.

The determined values of the above measurements are shown in Table 5.

It is understood that, with an intermediate rolling at temperatures outside the range of the invention, the grain size of the austenite would be larger than 25 μm and that the mechanical and metallurgical properties would be degraded.

TABLE 5

| Specimen No. | Starting temperature of Intermediate rolling (°C.) | *1 | Tensile Test T.S. kg f/mm$^2$ | R.A. (%) | L.C. (%) | S.R. (%) | NOTE |
|---|---|---|---|---|---|---|---|
| S45C | 850 | 40 | 56 | 55 | 65 | 82 | |
| | 810 | 33 | 55 | 59 | 66 | 85 | |
| | 770 | 23 | 52 | 68 | 74 | 97 | Invention |
| | 740 | 20 | 50 | 69 | 74 | 98 | Invention |
| | 710 | 18 | 50 | 69 | 73 | 98 | Invention |
| SCM 435 | 850 | 43 | 57 | 67 | 59 | 85 | |
| | 810 | 35 | 55 | 69 | 63 | 90 | |
| | 770 | 25 | 52 | 75 | 73 | 98 | Invention |
| | 730 | 20 | 51 | 79 | 75 | 99 | Invention |
| | 690 | 20 | 50 | 78 | 75 | 100 | Invention |

*1: Grain size of austenite after Intermediate rolling

Example 8

With respect to the steel shown in Table 1, the intermediate rolling was conducted at 700° C. from 35ϕ mm to 30ϕ mm. The rolled steels were water cooled to the starting teperature of the finish rolling shown in Table 6 and the finish rolling was conducted up to a diameter 20ϕ mm. The finish-rolled steels were coiled and isothermally maintained for 20 minutes in a continuous furnace.

The tensile strength, reduction of area, threshhold limit compressibility and the spheroidizing ratio of cementite were measured and shown in Table 6. It is understood from the results shown in Table 6 that the steel wires which have been pretreated and finish rolled within the temperature range begween $Ar_1$ and $Ar_3$ or between $Ar_1$ and Arcm exhibit a lower tensile strength and elevated reduction of erea, threshhold limit compressibility and spheroidizing ratio.

TABLE 6

| Specimen No. | Indication of JIS | Starting temperature of Finish working (°C.) | Tensile Test T.S. kg f/mm² | R.A. (%) | L.C. (%) | S.R. (%) | NOTE |
|---|---|---|---|---|---|---|---|
| 43 | S20C | 720 | 53 | 63 | 61 | 50 | |
| 44 | | 690 | 46 | 79 | 80 | 92 | Invention |
| 45 | | 670 | 46 | 83 | 81 | 95 | Invention |
| 46 | | 650 | 45 | 80 | 80 | 93 | Invention |
| 47 | | 620 | 56 | 64 | 55 | 70 | |
| 48 | S45C | 720 | 57 | 53 | 58 | 50 | |
| 49 | | 690 | 52 | 63 | 70 | 95 | Invention |
| 50 | | 670 | 52 | 68 | 74 | 97 | Invention |
| 51 | | 650 | 51 | 65 | 73 | 97 | Invention |
| 52 | | 620 | 68 | 52 | 53 | 85 | |
| 53 | SCr 435 | 700 | 58 | 50 | 61 | 63 | |
| 54 | | 670 | 53 | 72 | 70 | 93 | Invention |
| 55 | | 650 | 51 | 75 | 75 | 100 | Invention |
| 56 | | 620 | 52 | 73 | 72 | 98 | Invention |
| 57 | | 590 | 71 | 51 | 52 | 80 | |
| 58 | SCM 435 | 700 | 60 | 64 | 54 | 78 | |
| 59 | | 670 | 52 | 76 | 68 | 90 | Invention |
| 60 | | 650 | 52 | 75 | 73 | 98 | Invention |
| 61 | | 620 | 53 | 73 | 69 | 97 | Invention |
| 62 | | 590 | 70 | 55 | 45 | 83 | |
| 63 | SUJ2 | 700 | 69 | 54 | 55 | 80 | |
| 64 | | 670 | 62 | 64 | 60 | 99 | Invention |
| 65 | | 650 | 60 | 68 | 62 | 100 | Invention |
| 66 | | 620 | 62 | 64 | 60 | 100 | Invention |
| 67 | | 590 | 83 | 40 | 41 | 93 | |
| 68 | S12C | 710 | 46 | 73 | 72 | 46 | |
| 69 | | 680 | 42 | 80 | 83 | 89 | Invention |
| 70 | | 660 | 40 | 82 | 86 | 93 | Invention |
| 71 | | 630 | 41 | 82 | 86 | 92 | Invention |
| 72 | | 610 | 49 | 71 | 65 | 78 | |

Example 9

With respect to the steel of S45C, the intermediate rolling was conducted under the same condition as that of Example 8. Then the steel was finish rolled at 670° C. by varying the reduction ratio from 0% to 75%, and immediately coiled and isothermally maintained at 700° C. for 20 minutes. Here, reduction ratio of 0% means that the steel intermediately rolled was directly (without finish rolling) coiled in the isothermal furnace.

Figure 12:
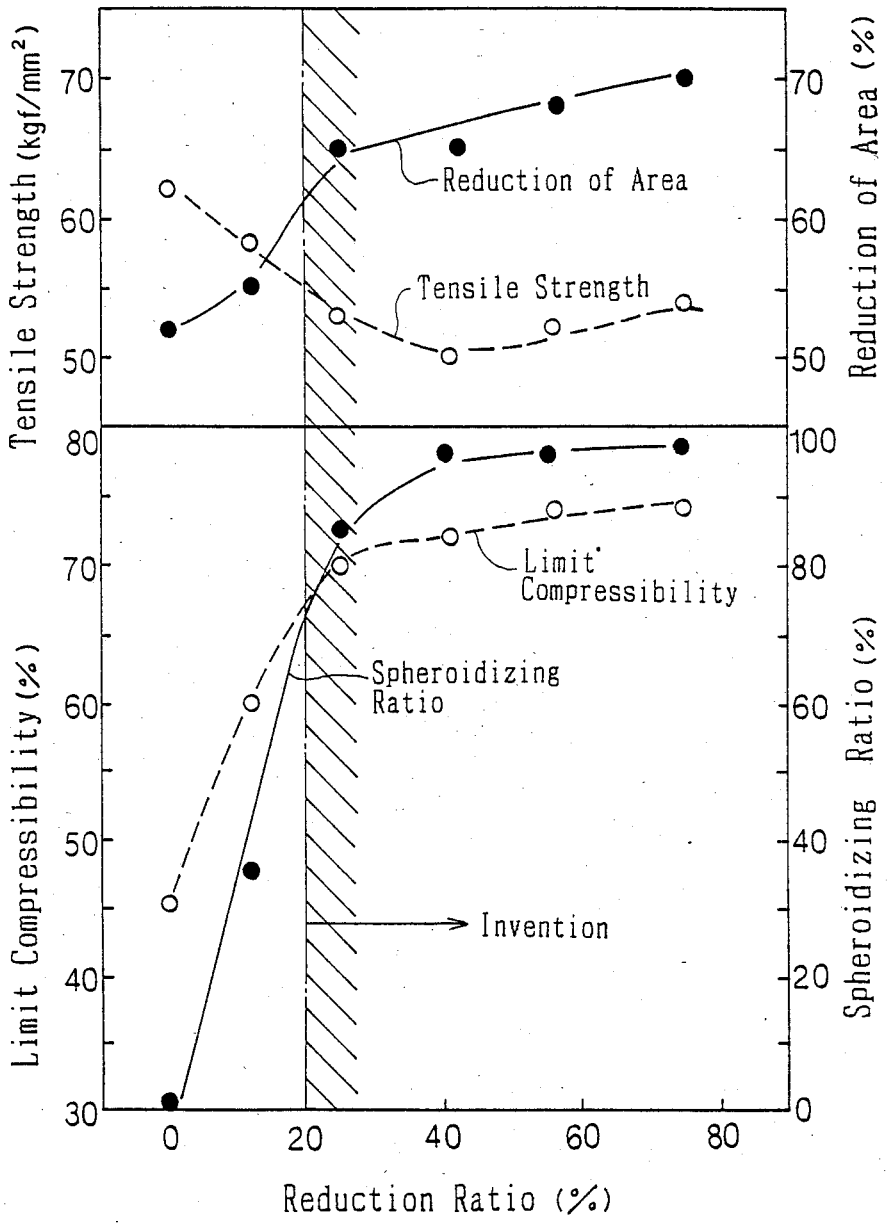
FIGS. 12 to 15 show respectively the results of the Examples of Group III.

The tensile strength, reduction of area, threshhold limit compressibility and the spheroidizing ratio of cementite of the resulting steel are shown in FIG. 12. It is understood that the steels finish-rolled with a reduction ratio of more than 20% have a lower tensile strength and improved reduction of area, threshold limit compressibility and spheroidizing ratio of cementite. It should be noted that the threshold limit compressibility and the spheroidizing ratio were acutely degraded if the finish rolling was conducted outside the scope of the present invention.

Example 10

With respect to the steels of S45C and SCM435, the rolling was conducted respectively under the same condition as that of specimen No. 50 (the starting teperature of the finish rolling being 670° C.) and specimen No. 60 (the starting teperature of the finish rolling being 650° C.) of Example 8. After the finish rolling, the steels were isothermally maintained for various time duration from 0 minute to 20 minutes. Further, the finish-rolled specimen of S45C was isothermally maintained for 20 minutes by varying the temperature from 550° C. to 750° C.

Figure 13:
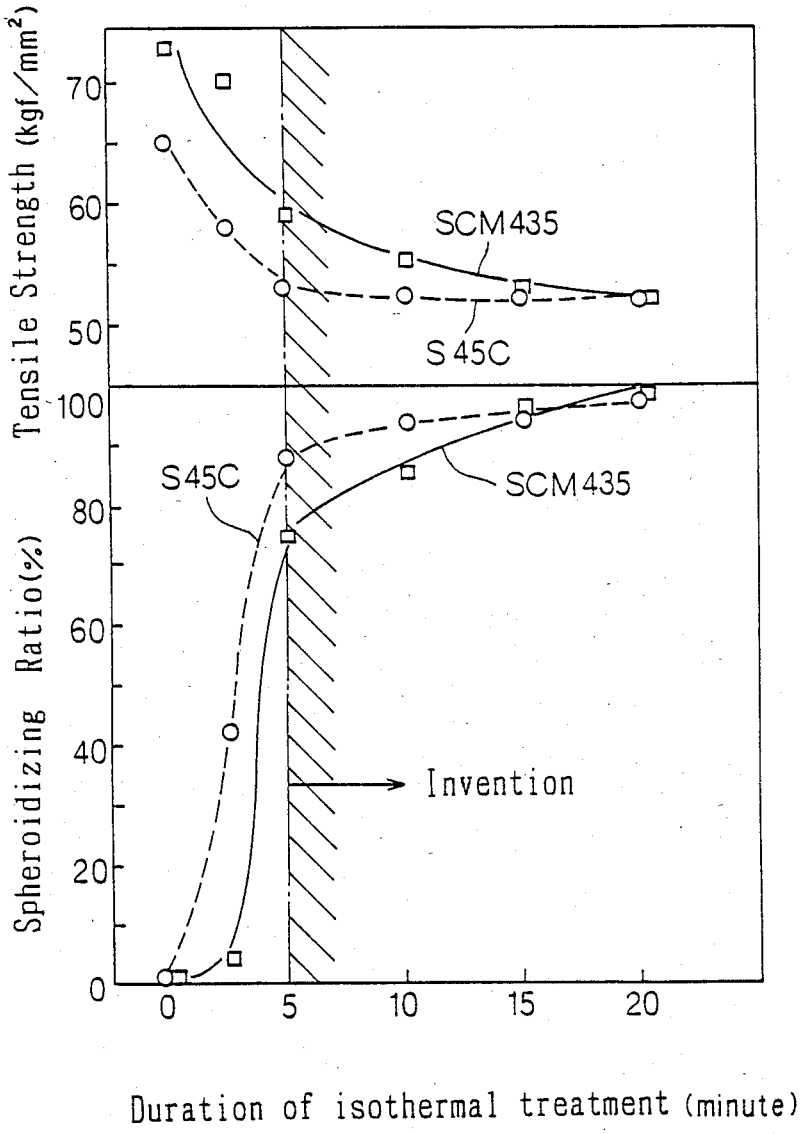
Figure 14:
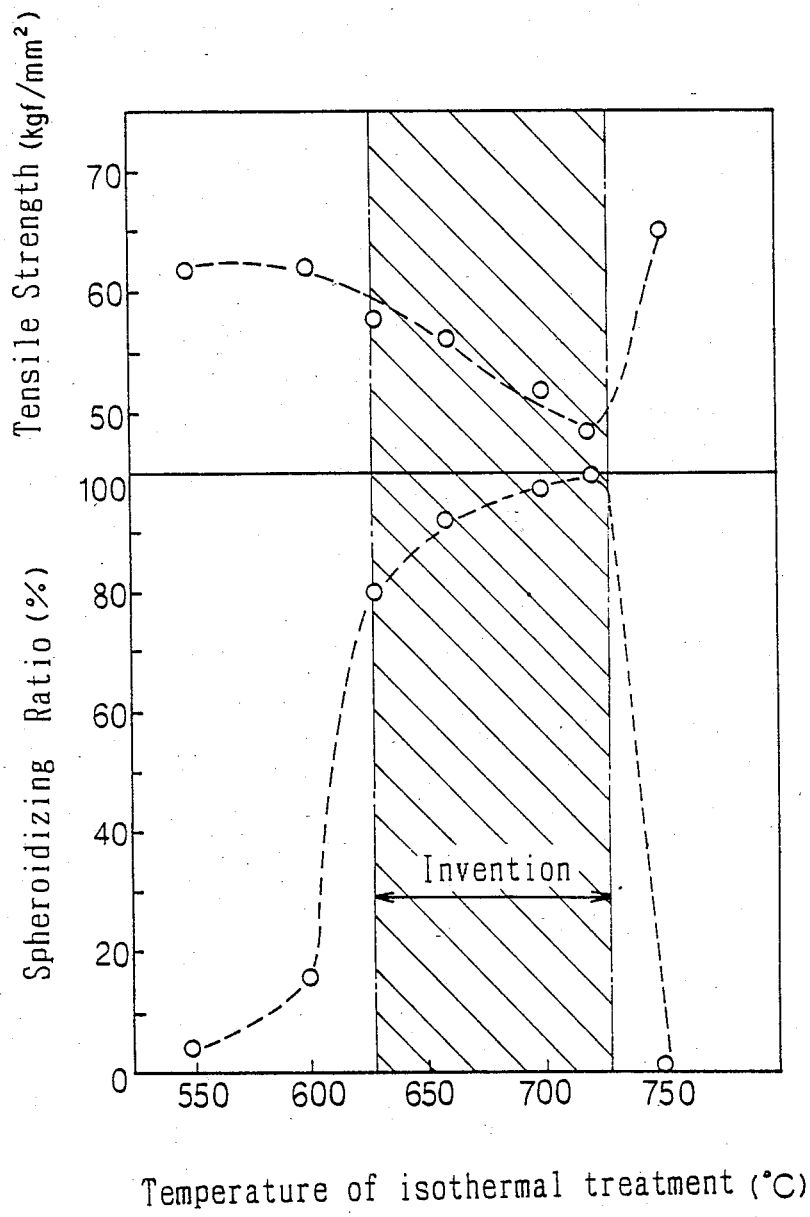

The tensile strength and the spheroidizing ratio of these steels are shown in FIGS. 13 and 14. It is understood from these results that only the steels annealed within the scope of the present invention exhibit excellent properties.

Example 11

With respect to the steels of S45C and SCM435, the rolling was conducted respectively under the same condition as that of specimen No. 50 (the starting teperature of the finish rolling being 670° C.) and specimen No. 60 (the starting teperature of the finish rolling being 650° C.) of Example 8. After the finish rolling, the steels were immediately coiled in a continuous slow cooling furnace. While transferring them in the furnace, the steels were slowly cooled to 500° C. by varying the cooling rate from 20° C./minute to 200° C./minute.

Figure 15:
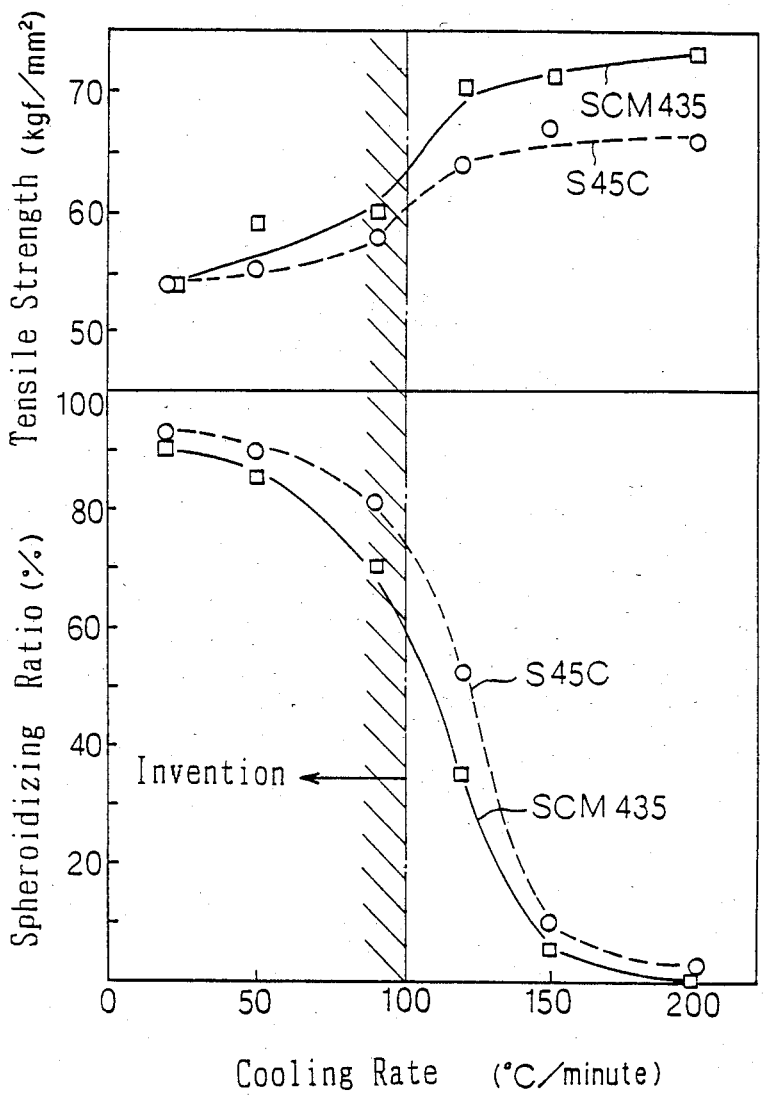

The tensile strength and the spheroidizing ratio of these steels are shown in FIG. 15. It is understood from these results that a lower tensile strength and an improved spheroidizing ratio of cementite are obtainable when the slow cooling is conducted at a cooling rate within the scope of the present invention.

Example 12

With respect to the steels of S45C and SCM435, the rolling was conducted respectively under the same condition as that of specimen No. 50 (the starting teperature of the finish rolling being 670° C.) and specimen No. 60 (the starting teperature of the finish rolling being 650° C.) of Example 8. After the finish rolling, the steels were left to cool down naturally to the room temperature. On the other hand, each steel of S45C and SCM435 was subjected to a usual hot working and left to cool down naturally to the room temperature for comparison.

These steels of the invention and for comparison were subjected to a spheroidizing annealing treatment according to the heat pattern shown in FIG. 11, in which the slow cooling rate R was varied from 0.5° to 2° C./minute.

The tensile strength, reduction of area, threshhold limit compressibility and spheroidizing ratio of cementite of the resulting steel are shown in table 7. It is understood from Table 7 that the steels processed according to the present invention exhibit improved properties as the spheroidizing-annealed condition.

TABLE 7

| Indication of JIS | Cooling rate in annealing treatment (°C./min.) | Tensile Test T.S. kg f/mm² | R.A. (%) | L.C. (%) | S.R. (%) | NOTE |
|---|---|---|---|---|---|---|
| S45C | 0.5 | 50 | 67 | 75 | 96 | Invention |
| | 1.0 | 51 | 65 | 75 | 93 | Invention |
| | 1.5 | 54 | 64 | 73 | 91 | Invention |
| | 2.0 | 56 | 60 | 70 | 88 | Invention |
| | 0.5 | 58 | 54 | 58 | 65 | Comparison |
| | 1.0 | 62 | 52 | 55 | 60 | Comparison |
| | 1.5 | 64 | 52 | 55 | 60 | Comparison |
| | 2.0 | 64 | 50 | 53 | 53 | Comparison |
| SCM 435 | 0.5 | 52 | 74 | 74 | 98 | Invention |
| | 1.0 | 54 | 72 | 72 | 96 | Invention |
| | 1.5 | 56 | 70 | 71 | 90 | Invention |
| | 2.0 | 57 | 69 | 67 | 87 | Invention |
| | 0.5 | 62 | 68 | 55 | 85 | Comparison |
| | 1.0 | 65 | 65 | 51 | 84 | Comparison |
| | 1.5 | 65 | 64 | 50 | 80 | Comparison |
| | 2.0 | 67 | 59 | 50 | 85 | Comparison |

GROUP IV OF EXAMPLES

Example 13

The steels having the chemical composition shown in Table 1 were prepared by a usual melting method and steel bars each having a diameter of from 15.4 to 164.0ϕ mm were produced therefrom. These steel bars were heated for 4 hours and rolled to a bar of 11.0ϕ mm by means of Nos. 1 to 9 rolling mills. The rollings by Nos. 1 to 3, by Nos. 4 to 6 and by Nos. 7 to 9 are respectively continuously conducted. The controlled cooling was conducted by the forcible cooling between No. 3 and No. 4, and between No. 6 and No. 7. The heating temperature of each steel, the starting and final teperatures and the reduction ratio of each rolling, and the transformation teperatures in equilibrium condition are indicated in Table 8.

On the other hand, the identical rollings were conducted, but the steels were water quenched immediately before and immediately after of the mills Nos. 1, 4 and 7 to observe the metallurgical structure thereof. It was observed that, just before the rollings Nos. 1, 4 and 7, the metallurgical structure of the steel is consists of austenite, and just after the rollings of Nos. 1, 4 and 7, the bainite or pearlite was already formed.

From the above observation, it is understood that the rolling was conducted according to the embodiment of the present invention.

Nextly, after the above continuous rolling, the steels were left to cool down or slowly cooled at a cooling rate of 20° C./min. The spheroidizing ratio of the resulting steels are shown in Table 8.

TABLE 8

| Steel No. | $Ae_1$ °C. | $Ae_3$ °C. | Heating temp °C. | No. 1 to No. 3 rolling Starting temp. °C. | Final temp. °C. | Reduction ratio % | No. 4 to No. 6 rolling Starting temp. °C. | Final temp. °C. | Reduction ratio % | No. 7 to No. 9 rolling Starting temp. °C. | Final temp. °C. | Reduction ratio % | Spheroidizing ratio (%) 20° C./min cooling | natural cooling |
|---|---|---|---|---|---|---|---|---|---|---|---|---|---|---|
| A | 731 | 815 | 1050 | 690 | 730 | 75 | 690 | 750 | 50 | 705 | 740 | 25 | 88 | 72 |
| | | | 800 | 670 | 710 | 75 | 695 | 790 | 75 | 695 | 780 | 75 | 99 | 87 |
| B | 727 | 776 | 900 | 690 | 720 | 25 | 710 | 745 | 20 | 710 | 740 | 15 | 80 | 70 |
| | | | 750 | 670 | 710 | 60 | 695 | 755 | 60 | 695 | 760 | 60 | 94 | 81 |
| C | 740 | 793 | 950 | 670 | 700 | 25 | 700 | 755 | 30 | 710 | 790 | 70 | 85 | 72 |
| | | | 750 | 650 | 710 | 70 | 700 | 790 | 70 | 695 | 790 | 70 | 98 | 85 |
| D | 742 | 790 | 1000 | 670 | 715 | 30 | 700 | 760 | 60 | 705 | 755 | 30 | 84 | 75 |
| | | | 780 | 650 | 740 | 90 | 665 | 780 | 85 | 650 | 755 | 80 | 100 | 85 |
| E | 745 | 814 | 1100 | 670 | 700 | 20 | 690 | 775 | 40 | 715 | 780 | 60 | 89 | 77 |
| | | | 780 | 650 | 735 | 70 | 680 | 775 | 70 | 715 | 805 | 70 | 95 | 83 |
| F | 732 | 880 | 1050 | 680 | 730 | 75 | 700 | 760 | 50 | 710 | 750 | 25 | 84 | 70 |
| | | | 800 | 660 | 710 | 75 | 670 | 780 | 75 | 680 | 790 | 75 | 98 | 88 |

When the steels shown in Table 1 were processed by a usual method, for example by heating at 1050° C., and the rolling being conducted from 950° C. to 1040° C. with a reduction 60% and leaving to cool down naturally, the carbides were precipitated in the lamellar form in the case of steel specimen A, B, E and F. (The steel specimens C and D present bainitic structure and thus the measurement of the spheroidizing ratio was not possible.)

Contrary to this, the steels processed according to the present embodiment of this invention exhibit always a spheroidizing ratio of higher than 70%, and if the slow cooling is conducted after the rolling, they exhibit a spheroidizing ratio as high as more than 85%.

Figure 16:
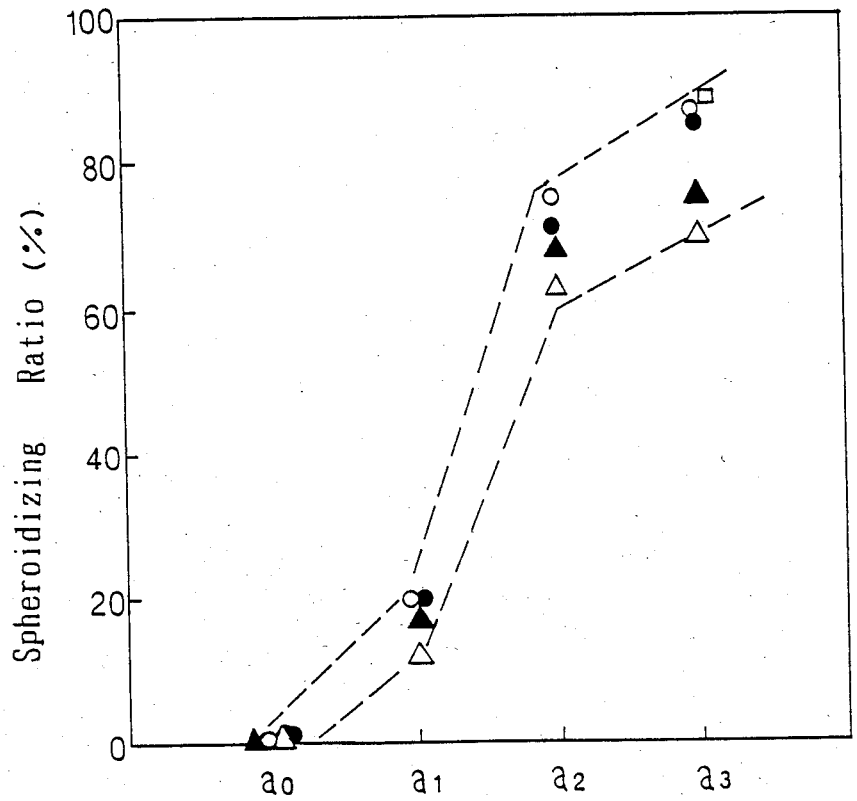
FIG. 16 shows the spheroidizing ratio of the Examples of Group IV.

With respect to the specimens A(heated at 800° C.), B(heated at 900° C.), C(heated 750° C.) and D(heated at 1000° C.), F(heated at 800° C.), the spheroidizing ratio of the steels which were naturally cooled after the rolling Nos. 1 to 3, Nos. 1 to 6 and Nos. 1 to 9 and of the steel naturally cooled after the usual hot rolling, are shown in FIG. 16. In FIG. 16, hollow circle indicates the spheroidizing ratio of steel A, hollow triangle indicates that of Steel B, the solid circle does that of the steel C, the solid triangle does that of steel D, and hollow square does that of steel F.

From the result shown in FIG. 16, it is understood that the steels cooled after the rollings Nos. 1 to 6 and after the rollings Nos. 1 to 9 exhibit a spheroidizing ratio of more than 60%. But the steel naturally cooled drown only after rolling Nos. 1 to 3 exhibit a spheroidizing ratio as low as 20%. These results mean that the cooling and the hot working must be repeated at least 2 times in order to exert the effect.

As explained in detail hereinbefore, the steel bar or steel wire produced according to the present invention has an improved spheroidizing ratio of cementite and an excellent mechanical properties.

We claim:

1. Process for producing a steel bar or steel wire, which comprises:

heating a steel containing less than 2% of C at a temperature higher than the $Ac_1$ point of the steel;

rough working the heated steel;

finish working the rough-worked steel within a temperature range between $Ar_1$ and $Ar_3$ or Arcm with a reduction ratio of at least 20%; and cooling the finish-worked steel at a cooling rate of lower than 60° C./minute to a temperature lower than 500° C.;

thereby providing a steel bar or steel wire having a spheroidal cememtite structure.

2. Process as claimed in claim 1, wherein the steel is a plain carbon steel containing not higher than 0.15% of C or a low alloy steel having a hardenability not higher than that of 0.15% C plain carbon steel, and further comprising a step of:

cooling the rough-worked steel at a cooling rate higher than 250° C./sec. to a temperature between $Ar_1$ and $Ar_3$.

3. Process as claimed in claim 1, wherein the steel is a plain carbon steel containing 0.15 to 0.4% of C or a low alloy steel having a hardenability between those of 0.15% to 0.4% C plain carbon steel, and further comprising a step of:

cooling the rough-worked steel at a cooling rate higher than 10° C./sec. to a temprature between $Ar_1$ *and* $Ar_3$.

4. Process as claimed in claim 1, wherein the steel is a plain carbon steel containing not lower than 0.4% of C or a low alloy steel having a hardenability not lower than that of 0.4% C plain carbon steel, and further comprising a step of:

cooling the rough-worked steel at a cooling rate higher than 2° C./sec. to a temperature between $Ar_1$ and $Ar_3$ or Arcm.

5. Process as claimed in claim 1, wherein the annealing treatment includes a step of:

immediately after the finish working, isothermally maintaining the finish-worked steel for at least 10 minutes at a temperature between ($Ae_1$ minus 100° C.) and $Ae_1$.

6. Process as claimed in claim 1, wherein the annealing treatment includes the steps of:

cooling the finish-worked steel to a temperature between $Ae_1$ and $Ar_1$;

working the cooled steel with a reduction of at least 15%, thereby to induce the pearlite or bainitic transformation of the steel and simultaneously to raise the temperature of the steel by the heat of mechanical deformation to a temperature between $Ac_1$ and $Ac_3$ or Accm; and, repeating said cooling and working steps.

7. Process as claimed in claim 1, which further comprises a step of:

before the finish working, working the steel with a reduction of at least 10% within a temperature range of between $Ar_3$ or Arcm and ($Ar_3$ plus 100° C.) or (Arcm plus 100° C.), thereby refining the austenitic grain size of the steel to lower than 25 μm.

* * * * *